United States Patent [19]

Yulish

[11] 4,097,944

[45] Jul. 4, 1978

[54] BEACH MAT

[76] Inventor: Eugene Norman Yulish, 67 E. 11th St., New York, N.Y. 10003

[21] Appl. No.: 795,861

[22] Filed: May 11, 1977

[51] Int. Cl.[2] ..... A47G 9/06

[52] U.S. Cl. ..... 5/344; 5/325

[58] Field of Search ..... 5/344, 325, 343; D6/201, 202, 204

[56] References Cited

U.S. PATENT DOCUMENTS

| | | | |
|---|---|---|---|
| 2,264,471 | 12/1941 | Glenn | 5/344 |
| 2,898,609 | 8/1959 | Storie | 5/344 |
| 3,176,315 | 4/1965 | Freund | 5/344 |
| 3,579,675 | 5/1971 | Scheer | 5/344 |

FOREIGN PATENT DOCUMENTS

| | | | |
|---|---|---|---|
| 77,288 | 9/1949 | Norway | 5/343 |
| 943,965 | 12/1963 | United Kingdom | 5/344 |

*Primary Examiner*—Paul R. Gilliam
*Assistant Examiner*—Alexander Grosz
*Attorney, Agent, or Firm*—Paul and Paul

[57] ABSTRACT

A beach mat is formed having an integral pillow and pockets for beach wear or the like. An elongated fabric piece defines the body of the mat, and at one end is folded back upon itself to enclose a pillow in the central portion. In particular, the body of the mat is stitched to the pillow, and the flaps on either side of the pillow are also stitched to the fabric piece and appropriately cut and bound to define pockets for beach wear and the like. The opposite end of the mat carries tie straps, to enclose the appropriately folded mat in a neat package.

4 Claims, 5 Drawing Figures

BEACH MAT

BACKGROUND OF THE INVENTION

The present invention relates to beach gear, and more particularly to a mat for sunbathing and the like which accomodates the user and which is conveniently portable.

A common sight at resort beaches, lakes, swimming pools, and the like is a person or group struggling from an automobile to a selected site on the beach, laden with assorted beach paraphernalia. While food lockers, balls, frisbees, and the like may or may not be included, almost universally the burden will include assorted blankets and towels, pillows, various lotions and ointments, and various bags or suitcases containing articles of clothing. The image presented is sufficiently common virtually to constitute a caricature of itself; the person slipping and sliding through the sand while supporting a precarious pyramid of assorted materials to be spread out as the person's own oasis on the beach.

Equally common is the scene, either at the end of the day or at the onset of bad weather, of repacking and removal of the same sundry goods back to the automobile. Indeed, the process of attempting to shake or remove water and sand from assorted blankets, towels, pillows, and clothing, and folding them all neatly for the trek home, forms a comical scene mating perfectly with the morning schlepp from car to beach.

It is a primary object of the present invention to alleviate the inconveniences associated with bringing necessary paraphernalia to the beach.

It is a more particular object of the present invention to provide a beach mat in which the necessary sunbathing accoutriments are contained in a single, integral package.

It is a further object of the present invention to provide a beach mat which is configured for convenient folding into a compact arrangement, which may be easily carried as desired.

SUMMARY OF THE INVENTION

The present invention involves an integral beach mat which carries its own pillow and also pockets for storage of lotions, food, clothing or the like. The pillow and pockets are integral with the base mat, conveniently at one end thereof, and define a basis for folding the mat into a neat package with pillow and pockets in the center of the package. Tie straps are provided at the end of the mat opposite the pillow, to hold the folded mat in package form, and also to define handles for easy carrying.

DETAILED DESCRIPTION

Figure 1:
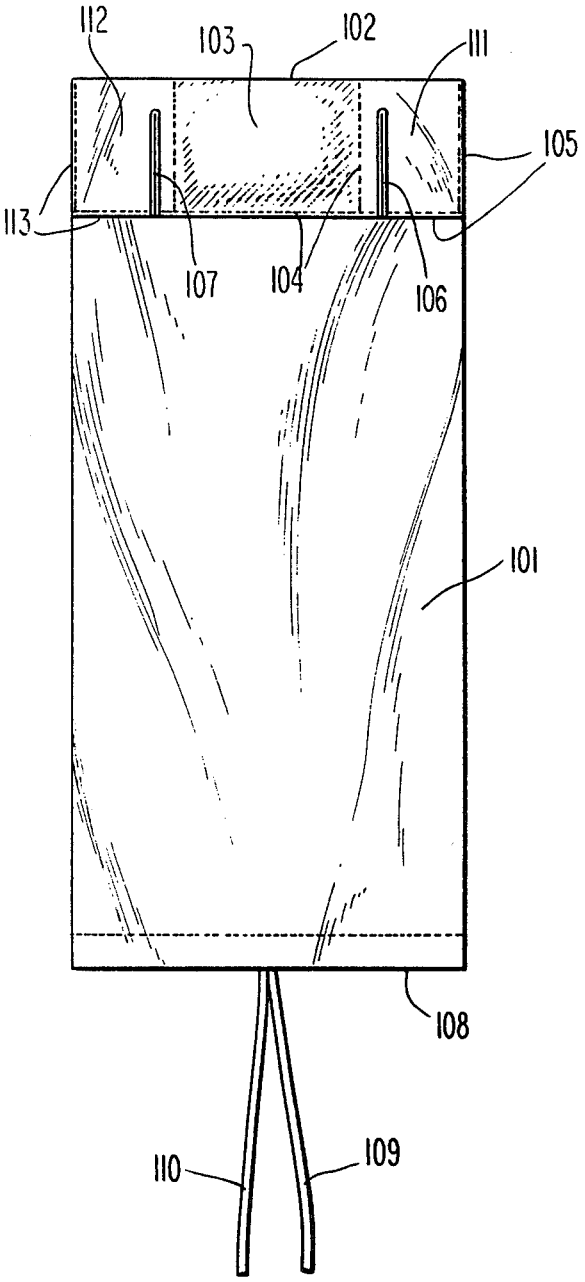
FIG. 1 shows a top elevational view of a beach mat incorporating the principles of the present invention, with the mat in its full outspread position.

Referring first to FIG. 1, there is shown a preferred embodiment of the present invention. In FIG. 1, the body of the mat is defined by an elongated, generally rectangular fabric piece 101. In preferred embodiments, the fabric piece 101 is canvas or terrycloth, but it will be apparent that the composition of the mat will vary in accordance with the needs and desires of those of ordinary skill in the art. For example, reflective or synthetic materials may be utilized to promote the suntanning process, or layers of materials may be employed respectively to promote absorption, structural integrity, and the like.

At one extremity of the mat there is provided a central pillow 103 and side pockets 111 and 112. In a preferred embodiment, the material covering pillow 103 and pockets 111 and 112 is an extension of the base mat 101, folded back against itself at 102. In such instance, the pillow is defined by stitching at 104, and the pockets are secured also by stitching at 105 and 113. The pockets are formed by openings at 106 and 107, which are suitably bound to prevent fraying or the like. In an alternative embodiment, the pillow 103 and the side pockets 111 and 112 may be fabricated from discrete parts, which are stitched to the base mat 101 not only at seams 104, 105, and 113, but also along the topmost edge 102.

The stuffing for pillow 103 may be any conventionally utilized pillow stuffing material, including synthetics such as dacron, shredded foam, and the like, or natural materials such as down, kapok, and the like. It will be appreciated that waterproofing is a desired attribute, for the pillow stuffing, and to that end the materials forming the stuffing of pillow 103 are preferably waterproof in and of themselves, or at least are hermetically sealed in a waterproof enclosure.

The pockets 111 and 112 form a convenient storage place for clothing, but it will be understood that their utilization is limited only in accordance with the desires of the user. For example, suntan lotions, sunburn remedies, and the like may be kept in the pockets 111 and 112 on a virtually permanent basis. Also, pockets 111 and 112 may be utilized for refreshments or the like.

In FIG. 1, the openings 106 and 107 for pockets 111 and 112 are shown located in their preferred position, that is, on the inside of the mat near the pillow. At such location, the pockets 111 and 112 are selfsealing when the mat is folded as shown in FIGS. 2*a* through 2*d* and discussed hereinafter, and in such circumstance, extra means to seal the openings 106 and 107 are not required. It is to be understood, however, that those of ordinary skill in the art may wish to provide means for sealing the pocket openings 106 and 107, including flaps, buttons, snaps, and the like. Likewise, the location of pocket openings 106 and 107 may be altered from that shown, in accordance with the desires of those of ordinary skill.

At the end of the fabric piece 101 opposite the pillow 103 is a bottom hem or binding 108, to which are attached elongated straps 109 and 110. The straps may be two separate pieces, affixed to the mat 101 in the region of 108, or may be a single elongated strap centrally attached to the mat 101. Straps 109 and 110 are made of the same material which defines the remainder of the mat 101, or alternatively may be ropes, leather belts or thongs, or the like. The purpose of straps 109 and 110 is to secure the folded mat as shown in FIGS. 2*a* through 2*d*, with sufficient extra length to provide convenient carrying handles for the folded package.

Figure 2A:
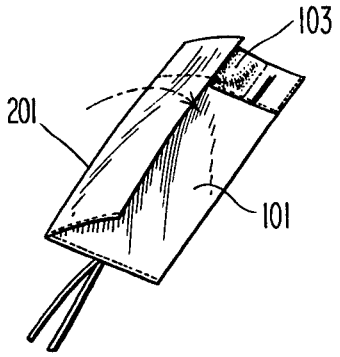
FIGS. 2*a* through 2*d* illustrate a sequence of operations whereby the mat of FIG. 1 is folded into a neat, compact package for easy carrying.
Figure 2B:
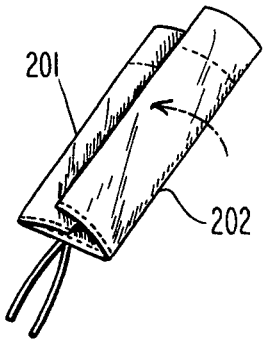
Figure 2C:
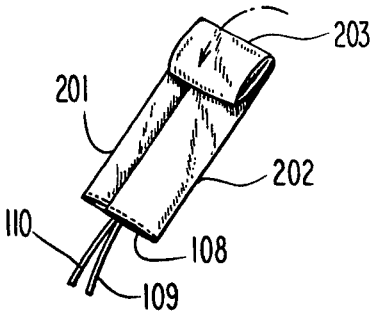
Figure 2D:
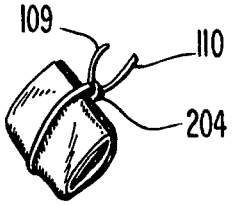

This convenient folding operation may be better understood upon consideration of FIGS. 2*a* through 2*d*. Briefly, those figures describe a preferred folding operation whereby the mat of FIG. 1 may be folded into a small, purse-like configuration convenient for carrying, with the essential pocketed goods neatly contained in the center. As shown in FIGS. 2*a* and 2*b*, successive longitudinal folds 201 and 202 bring the pocket portions 111 and 112 against and above the pillow portion 103. The longitudinal folds 201 and 202 are essentially along the pocket openings 106 and 107, thereby effectively sealing the pockets 111 and 112, and safely enclosing the contents thereof. As shown in FIG. *2c*, once the longitudinal folds 201 and 202 are completed, a succession of transverse folds 203 are completed, from top to bottom, thereby rolling the pillow-pocket portion down towards the straps 109 and 110. As shown in FIG. *2d*, when the rolled portion is brought essentially to the bottom end 108, straps 109 and 110 are brought around the package, are knotted together at 204, and leave protruding portions which are useful as handles.

In a preferred embodiment, the entire mat 101, from end to end, is in the range of 6 feet long, and 2½ to 3 feet wide. The pillow and pocket portion is somewhat less than a foot in length, such that a convenient thickness of the final package (FIG. *2d*) will be achieved by four transverse folds 203 as shown in FIG. *2c*.

It is to be understood that the foregoing represents disclosure of preferred and illustrative features of the present invention, and that numerous alternative embodiments and features will occur to those of ordinary skill in the art without departure from the spirit or scope of the present invention.

I claim:

1. A beach mat comprising:

an elongated, generally rectangular fabric piece which when flat defines the extent of said mat;

pillow means attached to and at one longitudinal extremity of said fabric piece, said pillow being centered substantially on the longitudinal axis of said piece, said pillow having a width extending in both directions from said axis to predetermined distances short of the side extremities of said fabric piece; wherein said pillow means and said fabric piece together comprise on integral unit;

a plurality of rectangular fabric overlays, on each side of said pillow and extending from the end of said pillow to the associated side extremity of said fabric piece, each of said fabric overlay being attached to said fabric piece on three sides to define storage pockets; and a pair of strap means attached to said piece generally along said axis of said on the longitudinal extremity opposite said one longitudinal extremity and wherein said fabric piece includes an integral flap portion at said one longitudinal extremity, said flap portion being folded back toward said opposite end and affixed to said fabric piece to define an outer cover for said pillow means and to constitute said fabric overlays defining said storage pockets, and said pockets formed by said overlays open towards said pillow, and are closed towards said longitudinal extremities and said associated side extremity and wherein said pockets are automatically sealed when said fabric piece is folded co-axially about said pillow.

2. A mat as described in claim 1 wherein said strap means are of sufficient length to be tied around said fabric piece when said fabric piece is folded co-axially about said pillow, and wherein said strap means comprise handles for said mat when said fabric piece is in the folded condition.

3. A mat as described in claim 2 wherein said fabric piece constitutes terrycloth fabric.

4. A mat as described in claim 2 wherein said fabric piece constitutes canvas.

* * * * *